United States Patent [19]

Harwood

[11] Patent Number: 4,591,957

[45] Date of Patent: May 27, 1986

[54] LIGHTING DISTRIBUTION SYSTEM

[76] Inventor: Ronald P. Harwood, 30733 W. Ten Mile Rd., Farmington Hills, Mich. 48024

[21] Appl. No.: 767,881

[22] Filed: Aug. 21, 1985

[51] Int. Cl.[4] ..... F21S 3/02

[52] U.S. Cl. ..... 362/148; 362/249; 362/217; 362/225

[58] Field of Search ..... 362/227, 225, 249, 145, 362/148, 217

[56] References Cited

U.S. PATENT DOCUMENTS 3,638,012 1/1972 Lenz et al. ..... 362/227

*Primary Examiner*—E. Rollins Cross

*Attorney, Agent, or Firm*—M. G. Berkman

[57] ABSTRACT

A lighting fixture which includes, in combination, a housing for a fluorescent lamp, and a lighting track for supporting a track fixture. The track is attached to and supported by the housing of the fluorescent fixture and extends along a sidewall of the housing to present an appearance which is aesthetically pleasing. Optionally, two lighting tracks may be used, one extending along each of opposed sidewalls of the housing. The invention provides the option of using track lighting, including spotlighting, which may be oriented and directed to augment and to enhance more general illumination provided by the fluorescent lamps. The fluorescent lamp and the incandescent track light are fed by a single power supply.

17 Claims, 8 Drawing Figures

LIGHTING DISTRIBUTION SYSTEM

BACKGROUND OF THE INVENTION

This invention relates to light fixtures. More particularly, the invention is directed to a multiple utility and dual function lighting fixture providing the advantages of both fluorescent fixture general illumination and incandescent-lamp-directed accentuating zone illumination.

Ceiling mounted fluorescent lighting fixtures are widely used for providing efficient general illumination, especially in business establishments such as department stores, clothing stores, offices, furniture stores, hardware stores, supermarkets and others. In many types of environments such general illumination has proven satisfactory and even adequate. In other situations it has been found desirable and advantageous to augment the general fluorescent illumination with auxiliary incandescent lamps. One way this has been accomplished is by installing separate track lighting.

At the time of new construction it is quite difficult to predict with a degree of assurance where such auxiliary track lighting may be needed or may be advantageous. As a result, any track then installed may not turn out to be at hand in those areas where it is later determined such lighting would be desirable. To remedy this situation, one would have to install additional tracks, at considerable expense and with objectionable disruption of normal business or sales activities. Similar added expense and inconvenience are experienced when track lighting is added upon recognizing a need in an establishment already in operation.

Even in those instances in which the track lighting is properly located when installed prior to occupation of the premises, or properly located later, after occupation, changes in the use of the space itself or relocation of or rearrangement of displays, items, etc., to be illuminated make it necessary to move the track lighting or to install new track lighting at different locations. Again, there is associated additional expense, and disruption, and interference with "business as usual."

It is a principal aim of the present invention to eliminate problems of the type identified above and to provide an improved lighting system including a fixture having a versatility and adaptability not heretofore known. Thus, the unique advantages of both general fluorescent illumination and the more definitively directional lighting provided by track fixtures may be realized.

SUMMARY OF THE INVENTION

The light fixture of the present invention provides the concurrent capability of both fluorescent and incandescent illumination, conveniently and effectively, from a given power takeoff.

It is an important feature of the invention that each of two distinct functions including the general illumination by fluorescent lamps and the spot or directed illumination provided by incandescent lamps is achieved without impairing or otherwise interfering with the other.

A related and important aesthetic feature of the invention is that the track lighting capability of the fixture of the invention has been incorporated into or physically coordinated with the fluorescent fixture in a manner so as not adversely to affect the general appearance of the overall structure.

Yet another feature of the invention is that broad lighting options and capabilities are provided; tracks are provided at each fluorescent fixture location and, thus, any desired pattern of auxiliary track lighting is readily available.

In accordance with the present invention, the lighting pattern and accent may be conveniently altered at any time to meet current and changed requirements, without any need to add new wiring or basic fixtures.

A feature of the present invention is that it provides unlimited lighting options with ease of change and transformation while minimizing cost and eliminating any disruption in service and any interference with business activities.

Yet another advantage of the light fixture of the invention is that lighting provided by the optional track lamps may be moved, added or manipulated without any dependence on electrical technicians or other service personnel.

It is a feature of the present invention that it provides lighting versatility not heretofore possible, and achieves this in a very practical and economic manner.

Other and further objects, features and advantages of the invention will become evident upon consideration of the drawings and the following description.

BRIEF DESCRIPTION OF THE DRAWINGS

In the drawings, offered for illustrative purposes and not to be construed in any limiting sense.

DETAILED DESCRIPTION OF PREFERRED EMBODIMENTS

The aims and objects of the invention are accomplished by providing, in combination with a fluorescent fixture, to augment the utility and the illuminating capabilities and options thereof, a lighting track for supporting and energizing a selectively positionable incandescent track fixture. Electrical conductors extending between the lighting track and a power supply energize both the fluorescent and the incandescent lamps of the assembly.

Figure 1:
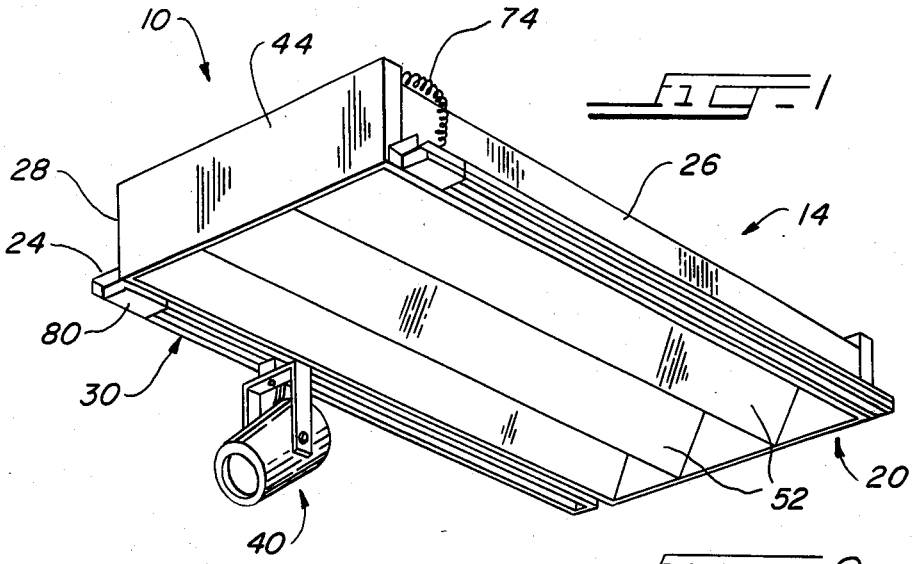
FIG. 1 is a perspective view of a fluorescent light fixture which includes track lighting capabilities and showing an incandescent track-carried lamp attached to and depending from the fixture, in accordance with the teachings of the present invention.
Figure 2:
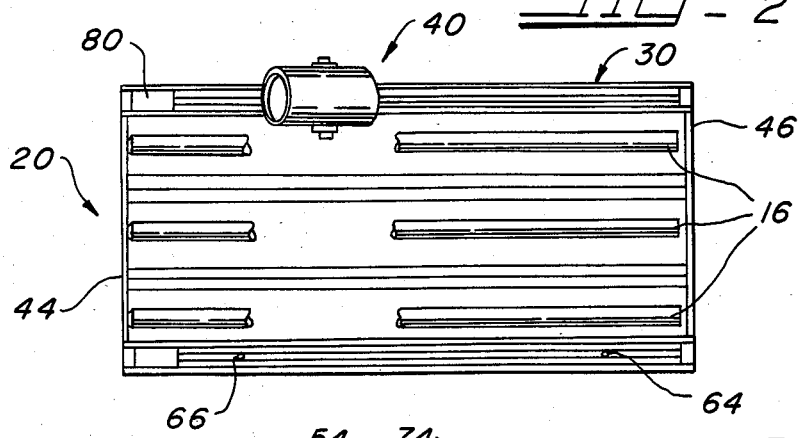
FIG. 2 is a bottom plan view of the fixture of FIG. 1, showing the fixture as installed in a ceiling and seen from below.
Figure 3:
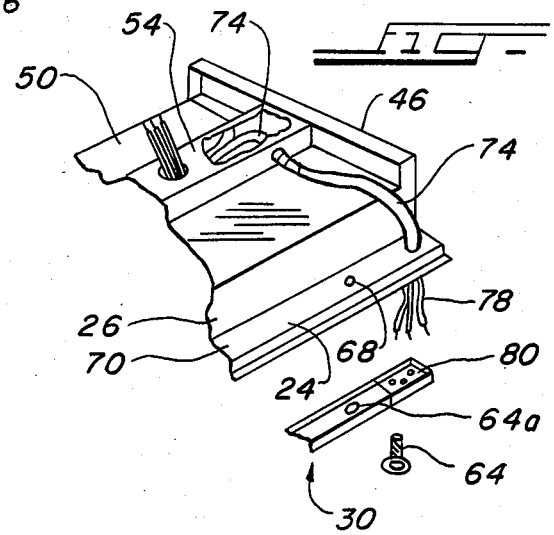
FIG. 3 is a fragmentary perspective view of an end portion of a fixture in accordance with the invention, as seen from above, and with the track element detached from the track channel of the fixture, and indicating schematically the manner of feeding electrical conduits from the track to the fixture wireway, and to a power supply.

As indicated in FIGS. 1, 2 and 3 of the drawings, in effectuating the aims and purposes of the invention, the assembly 10 of the invention embodies several principal components including a fluorescent fixture 14 fitted with fluorescent lamps 16 contained in a generally rectangular troffer or housing 20, a downwardly opening channel 24 secured to a sidewall 26 (and 28) of the housing 20 and extending therealong, and a lighting track 30 retained within the channel 24 and coextensive therewith.

The track 30 itself may be generally of a conventional configuration or design for accomodating an incandescent lighting lamp or fixture 40 which is, in the customary manner, positionable at selectable locations along the lineal expanse of the track 30. In a preferred embodiment of the invention a lighting track 30 is secured at each of opposed principal sides 26 and 28 of the housing 20. This arrangement augments the versatility of the assembly and enhances its symmetry and aesthetic appeal.

The particular precise configuration of the fluorescent fixture 14 or its troffer or housing 20 is not critical.

The exemplary structure is shown for facilitating the description and to enhance an understanding of the invention and not in any limiting sense. It will be appreciated that the housing 20 itself may be generally square rather than an elongated rectangle, and that the fixture 14 may be of the "recessed" type or surface mounted, or pendant.

Figure 7:
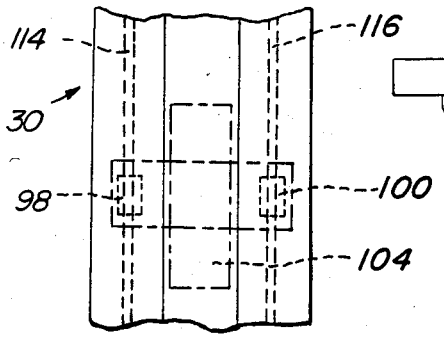
FIG. 7 is an enlarged fragmentary view looking upwardly into the track and indicating schematically the insertion mode and the securement mode of the incandescent lamp pivotal attachment lug.
Figure 8:
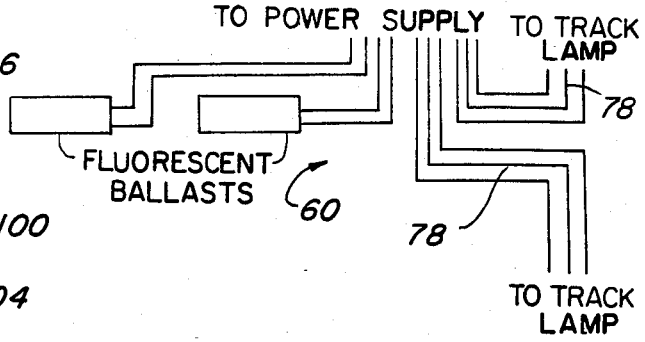
FIG. 8 is a wiring diagram indicating schematically the leads from the fluorescent lamps and from the track channels to a power supply.

Referring further to FIGS. 1–3 of the drawings, the housing 20 of the fixture 14, in the specific example illustrated, includes endwalls 44 and 46, a top wall 50, reflectors 52, and an enclosed wire way 54. The fixture 14 is also provided with ballasts 54 and associated wiring 60 (FIG. 7).

In the preferred embodiment of the invention illustrated, there are attached to the sidewalls 26 and 28 a pair of downwardly-opening, generally U-shaped channels 24 which are spot welded, bolted, or otherwise secured to the housing 20 at its longer sidewalls 26 and 28. The lighting tracks 30 are nested within and secured within the channels 24 by means of mounting screws 64 extending through cooperating slots **64*a* in a top wall 66 of the track 30 and engaged in cooperating holes 68 in the top wall 70 of the channel 24, as indicated schematically in FIG. 3**.

A flexible conduit 74 carries wires 78 from a junction box or terminal 80 from each lighting track 30 to the wire way 54 from which the conductors 78 exit, together with the leads 82 from the fluorescent lamps 16, for connection to a power supply (not shown).

The internal, functional construction of the lighting track 30 itself may take any preferred form. Such structures are well-known in the art and, accordingly, no detailed additional description is provided herein.

The incandescent lamp or light fixture 40 to be attached to the lighting track 30 may also be of any preferred design or configuration. Nor does the manner in which the lamp is fastened to the track 30 constitute an element of the invention.

Figure 6:
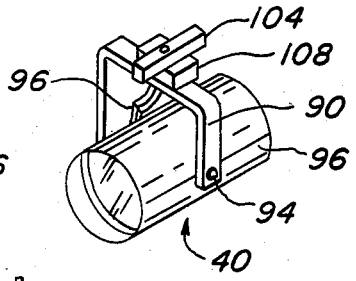
FIG. 6 is a perspective view of an incandescent lamp fixture of the type connectable to depend from the lighting track of the invention.

For purposes of illustrative disclosure and not in any limiting sense, the incandescent lamp 40 is shown (FIG. 6) as having a support yoke 90 secured at pivot pins 92 at either side of the cylindrical housing 94 of the lamp 40. Electrical wires 96 from the bulb socket (not shown) of the lamp are connected to each of opposed end zones 98 and 100 (insulated from one another) of an electrical contact bar 104 carried by a rotatable lug 108 which surmounts the yoke 90.

Figure 4:
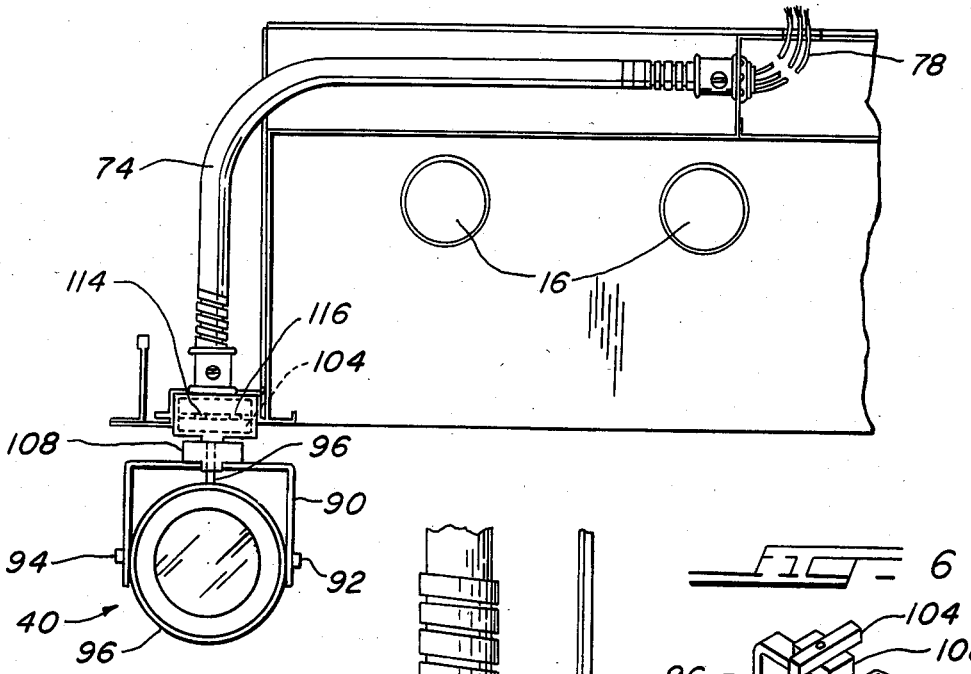
FIG. 4 is an end view of a fixture in accordance with the invention, with parts cut away to show the incandescent track seated in a side channel of the fixture and the electrical conduit from the track to the power supply.
Figure 5:
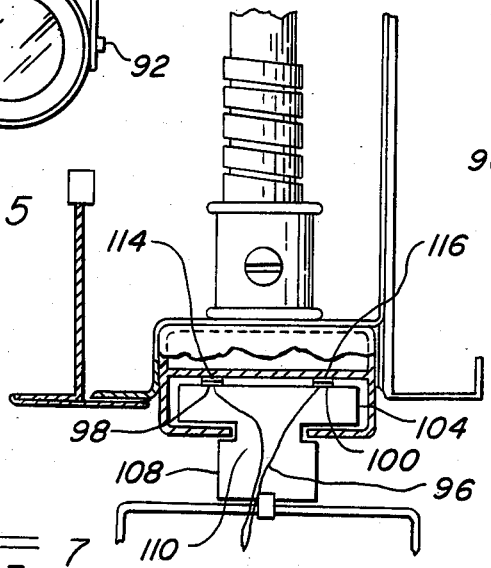
FIG. 5 is an enlarged, fragmentary view, taken substantially on the line of FIG. 5—5 of FIG. 4, and showing the manner of attachment of the incandescent fixture to depend from the track.

In attaching the fixture 40 to the lighting track, it is necessary merely to align the contact bar 104 with the slot 110 in the track 30, to insert the bar 104 into the track 30 and then to rotate the lug 108 (and the bar 104 carried by the lug 108) 90 , thereby to effect electrical contacting engagement of opposed end zones 98 and 100 of the bar 104 with corresponding operating conductors 114 and 116 in the track 30, all as shown in FIGS. 4 and 5 and indicated schematically in FIG. 7.

It will be appreciated that one or more lamps 40 may be attached to each track 30, at selected positions.

Optionally, the fixtures of the present invention may be used, at any particular time and under particular conditions or requirements, without any incandescent lamps. However, in accordance with the practice of the present invention, the diverse capabilities and options are always at hand.

While the foregoing description of the invention has been made with respect to preferred embodiments, persons skilled in the art will understand, in the light of the present disclosure, that numerous changes, modifications, and alterations may be made therein without departing from the spirit and scope of the appended claims.

For example, aims and objects of the invention may be achieved by addition of an incandescent lamp accommodating track to existing fluorescent fixtures as a retrofit kit, thus avoiding replacement of the entire pre-installed fluorescent fixture. Also, while in the preferred embodiment of the assembly illustrated herein the lighting track is seated within and secured within a downwardly opening channel fastened to the troffer of the fluorescent fixture, a flange may be used in place of the channel. All such variations, and others, which will come to mind without exercise of the inventive faculty are deemed to be within the scope of the invention as defined in the following claims.

What is claimed is:

1. In combination with a fluorescent lamp fixture including generally rectangular housing means for carrying a fluorescent lamp therewithin, and wire way means for carrying wires of said flourescent lamp fixture for connection to an electrical power supply, lighting track means for supporting a track fixture at a selectable position along a lineal expanse of said track means, attachment means for supporting said lighting track means adjacent said housing means to extend along a sidewall thereof, said lighting track means including electrical conductor means for engaging a track fixture in electrical contact for delivering electrical power thereto, wire means for connecting said electrical conductor means of said lighting track means to an electrical power supply for energizing a track fixture supported by and extending from said lighting track means.

2. The structure as set forth in claim 1 and further comprising flange means for fastening said lighting track means thereto, said flange means defining a lateral projection extending along a sidewall of said housing means, and means fastening said flange means to said housing means along the sidewall thereof, and wherein said attachment means secures said lighting track means to said flange means.

3. The structure as set forth in claim 2 wherein said flange means includes an elongated downwardly open channel essentially coextensive with said housing means at a sidewall thereof, and wherein said lighting track means nests within said channel of said flange means and is secured therewithin.

4. The structure as set forth in claim 1 wherein said lighting track means is adapted to support a selectively directionally positionable lamp.

5. The structure as set forth in claim 4 wherein said lamp is an incandescent lamp.

6. The structure as set forth in claim 1 wherein said lighting track means comprises a pair of tracks disposed to extend along each of an opposed pair of sidewalls of said housing.

7. The structure as set forth in claim 3 and further comprising fastener means for securing said lighting track means to a wall of said channel.

8. The structure as set forth in claim 1 wherein said lighting track means is essentially coextensive with said housing means along a sidewall thereof.

9. The structure as set forth in claim 7 wherein said lighting track means projects in a plane generally normal to a sidewall of said housing means.

10. The structure as set forth in claim 1 and further comprising a track fixture locked within and extending from said lighting track means.

11. In combination with a fluorescent fixture including generally rectangular housing means for carrying a fluorescent lamp therewithin, and wire way means for carrying wires of said fluorescent lamp fixture for connection to an electrical power supply, an adapter for supporting an incandescent light fixture, said adapter including:

lighting track means for securing a track fixture thereto at a selectable position along a lineal expanse of said track means, a frame supported in a ceiling opening of said fluorescent lamp fixture, means for attaching said lighting track means to said frame to extend along a side edge thereof, and wire means for connecting said lighting track means to an electrical power supply for energizing a track fixture carried by said lighting track means.

12. In a fluorescent lighting fixture including a generally rectangular housing for carrying a fluorescent lamp therewithin, and wire way means for carrying wires for connection to an electrical power supply, the improvement comprising lighting track means for supporting a track fixture at a selectable position along a lineal expanse of said lighting track means, attachment means for supporting said lighting track means adjacent said housing means to extend along a side edge thereof, and wire means for connecting said lighting track means to an electrical power supply for energizing a track fixture carried by said lighting track means.

13. The improvement as set forth in claim 12 wherein said fluorescent lighting fixture is a recessed fixture.

14. The improvement as set forth in claim 12 wherein said fluorescent lighting fixture is a surface mounted fixture.

15. The improvement as set forth in claim 12 wherein said fluorescent lighting fixture is a pendant fixture.

16. In a fluorescent ceiling fixture having a generally rectangular housing containing fluorescent lamps therewithin, the method of incorporating incandescent track lighting capabilities into the fluorescent fixture to enhance illuminating capabilities and to augment illuminating options and versatility of the fixture, said method including the steps of:

attaching at the housing of the fluorescent fixture, to extend coextensively along a side thereof flange means for securing a lighting track thereto, fastening to said flange means a lighting track including electrical conductors for electrically engaging at selectable positions along the length of said track electrical contacts of a connector plug of an incandescent light fixture to be attached to and to depend from said track, connecting electrically conducting means including wires between said electrical conductors of said lighting track and an exterior electrical power supply for energizing an incandescent fixture to be attached to said lighting track.

17. In a fluorescent ceiling fixture having a generally rectangular housing containing fluorescent lamps therewithin, the method of incorporating incandescent track lighting capabilities into the fluorescent fixture to enhance illuminating capabilities and to augment illuminating options and versatility of the fixture, said method including the steps of:

attaching a lighting track to the housing of the fluorescent fixture, to extend coextensively along a side thereof, said lighting track including electrical conductors for electrically engaging at selectable positions along the length of said track electrical contacts of a connector plug of an incandescent light fixture to be attached to and to depend from said track, connecting electrically conducting means including wires between said electrical conductors of said lighting track and an exterior electrical power supply for energizing an incandescent fixture to be attached to said lighting track.

* * * * *